US009707139B2

(12) United States Patent
Patel et al.

(10) Patent No.: US 9,707,139 B2
(45) Date of Patent: Jul. 18, 2017

(54) BACKREST ANGLE ADJUSTMENT SYSTEM ON A SEAT FOR A PHYSICALLY DISABLED PERSON

(71) Applicant: Roger Thomas Mascull and Elizabeth Jocelyn Mascull as Trustees of the RT and EJ Mascull Family Trust, Allenton, Ashburton (NZ)

(72) Inventors: Anil Raman Patel, Birmingham (GB); Graham John Mascull, Ashburton (NZ)

(73) Assignee: ROGER THOMAS MASCULL AND ELIZABETH JOCELYN MASCULL, Allenton, Ashburton (NZ), AS TRUSTEES OF THE RT AND EJ MASCULL FAMILY TRUST ( * ) Notice: Subject to any disclaimer, the term of this patent is extended or adjusted under 35 U.S.C. 154(b) by 0 days.

(21) Appl. No.: 14/768,306

(22) PCT Filed: Feb. 18, 2014

(86) PCT No.: PCT/NZ2014/000018
§ 371 (c)(1),
(2) Date: Aug. 17, 2015

(87) PCT Pub. No.: WO2014/126485
PCT Pub. Date: Aug. 21, 2014

(65) Prior Publication Data

US 2015/0374565 A1 Dec. 31, 2015

(30) Foreign Application Priority Data

Feb. 18, 2013 (NZ) ..... 607283
Feb. 18, 2013 (NZ) ..... 607284
(Continued)

(51) Int. Cl.
*A47C 7/50* (2006.01)
*A47C 20/04* (2006.01)
(Continued)

(52) U.S. Cl.
CPC ..... *A61G 5/1067* (2013.01); *A61G 5/1075* (2013.01); *A61G 5/1091* (2016.11); *A61G 5/12* (2013.01); *A61G 5/128* (2016.11)

(58) Field of Classification Search
CPC ..... A61G 5/1075; A61G 5/1067; A61G 5/12; A61G 5/127; A61G 5/128
(Continued)

(56) References Cited

U.S. PATENT DOCUMENTS 3,858,938 A * 1/1975 Kristensson ..... A61G 5/006 297/423.26 X
3,882,949 A * 5/1975 Anderson ..... A61G 5/045 180/8.2
(Continued)

FOREIGN PATENT DOCUMENTS

CN 202283131 6/2012
EP 0155918 9/1985
(Continued)

OTHER PUBLICATIONS

International Search Report for corresponding International Patent Application No. PCT/NZ2014/000018 mailed Jun. 11, 2014.
(Continued)

*Primary Examiner* — Rodney B White
(74) *Attorney, Agent, or Firm* — Merchant & Gould P.C.

(57) ABSTRACT

The invention relates to a seat, backrest, lateral support bracket, and footrest that are able to be adapted to suit the needs of a physically disabled user. In general, the seat comprises a base frame, a seat base that is supported by the base frame, and a backrest. The backrest may be adapted to
(Continued)

tilt with respect to the seat base and comprises a backrest angle adjustment system including a vertically extending angle adjustment slot located centrally on the backrest support and a pair of links pivotally attached to the seat frame and the angle adjuster wherein the angle adjuster comprises a lock with a projection through the angle adjustment slot and a fastener that engages with the projection.

18 Claims, 9 Drawing Sheets

(30) Foreign Application Priority Data

Feb. 18, 2013 (NZ) ..... 607285
Feb. 18, 2013 (NZ) ..... 607286

(51) Int. Cl.
*A61G 5/10* (2006.01)
*A61G 5/12* (2006.01)

(58) Field of Classification Search
USPC ..... 297/354.12, 423.26, 423.3
See application file for complete search history.

(56) References Cited

U.S. PATENT DOCUMENTS 3,950,026 A * 4/1976 Van Seenus ..... A61G 5/1059 297/115
4,033,624 A * 7/1977 Jun ..... A61G 5/12 297/423.3
4,389,070 A * 6/1983 Chien ..... A47C 1/024 297/423.26 X
4,402,546 A * 9/1983 Johnson ..... B60N 2/22 297/354.12
4,516,805 A * 5/1985 Leeper ..... A61G 15/005 297/423.26 X
4,655,471 A 4/1987 Peek
4,887,826 A * 12/1989 Kantner ..... A61G 5/08 297/423.26 X
4,945,582 A * 8/1990 Hayton ..... A61G 5/006 297/423.26
4,949,408 A * 8/1990 Trkla ..... A61G 5/006 297/DIG. 4
4,968,051 A * 11/1990 Luo ..... A61G 5/1067 297/423.26 X
5,044,647 A * 9/1991 Patterson ..... A61G 5/00 180/907
5,195,803 A * 3/1993 Quintile ..... A61G 5/1067 297/353
5,217,239 A * 6/1993 Koet ..... A61G 5/08 280/250.1
5,263,768 A * 11/1993 Scheulderman ..... A61G 5/1067 297/354.12
5,292,144 A * 3/1994 Sosnoff ..... A61G 5/006 280/304.1
5,342,112 A * 8/1994 Padovan ..... A47C 1/022 297/423.26 X
5,421,598 A * 6/1995 Robertson ..... A61G 5/00 297/423.26 X
6,154,690 A * 11/2000 Coleman ..... A61G 5/006 180/65.1
6,158,810 A 12/2000 Galloway
6,203,106 B1 * 3/2001 Nearing ..... A61G 5/107 297/284.9
6,322,145 B1 11/2001 Melgarejo
6,378,947 B1 4/2002 Barber et al.
6,450,581 B1 * 9/2002 Koerlin ..... A61G 5/12 297/423.26
7,360,840 B2 * 4/2008 Barlow ..... A61G 5/12 297/423.26 X
8,708,417 B2 * 4/2014 Mejuhas ..... B60N 2/62 297/423.26 X
9,028,002 B2 * 5/2015 Marini ..... B60N 2/4495 297/423.26
9,084,708 B2 * 7/2015 Horvath ..... A61G 5/1059
2002/0109389 A1 8/2002 Satoh
2002/0109390 A1 8/2002 Hagiike
2003/0042779 A1 * 3/2003 Yamasaki ..... A61G 5/08 297/362.13
2003/0075967 A1 * 4/2003 Ciolfe ..... A61G 5/12 297/423.32
2004/0021354 A1 * 2/2004 Hogg ..... A61G 5/1059 297/325
2004/0051279 A1 * 3/2004 Grant ..... A61G 5/1059 280/638
2004/0080190 A1 * 4/2004 Markwald ..... A61G 5/1064 297/61
2004/0084950 A1 * 5/2004 Markwald ..... A61G 5/1067 297/452.36
2005/0017561 A1 * 1/2005 Burmeister, III ..... B60N 2/015 297/354.12
2005/0088024 A1 4/2005 Rozaieski
2005/0183900 A1 * 8/2005 Goertzen ..... A61G 5/042 180/311
2006/0066143 A1 3/2006 Cerreto
2006/0208554 A1 * 9/2006 Nishiwaki ..... A61G 5/1064 297/452.3
2007/0085301 A1 * 4/2007 Watkins ..... A61G 5/08 280/642
2007/0102901 A1 * 5/2007 Murayama ..... A61G 5/08 280/642
2010/0156065 A1 * 6/2010 Cerreto ..... A61G 5/1075 280/281.1
2010/0244527 A1 * 9/2010 Chen ..... B62B 7/123 297/354.12
2012/0080919 A1 4/2012 Engman et al.
2012/0112507 A1 * 5/2012 Cerreto ..... A61G 5/1067 297/354.12 X
2012/0193946 A1 * 8/2012 Robertson ..... A47C 1/03294 297/354.12 X
2012/0292879 A1 * 11/2012 Ferniany ..... A61G 5/14 280/250.1
2013/0249190 A1 * 9/2013 Engman ..... A61G 5/12 297/423.26 X
2014/0103688 A1 * 4/2014 Wilson ..... A47C 1/03211 297/354.12 X
2014/0333111 A1 * 11/2014 Besler ..... A47C 1/035 297/423.26
2015/0108817 A1 * 4/2015 Meister ..... B64D 11/0648 297/423.26
2015/0202103 A1 * 7/2015 Olst ..... A61G 5/04 297/423.32
2015/0374564 A1 * 12/2015 Sutton ..... A61G 5/061 280/657
2016/0331609 A1 * 11/2016 Cheng ..... B60N 3/063

FOREIGN PATENT DOCUMENTS

EP 1852099 11/2007
GB 1 202 658 A 8/1970
WO WO 95/07678 A1 3/1995
WO 2004039299 5/2004
WO WO 2007/090677 A1 8/2007

OTHER PUBLICATIONS

European Search Report for EP Application No. 14751901.1 mailed Feb. 6, 2017 (9 pages).

* cited by examiner

Figure 11
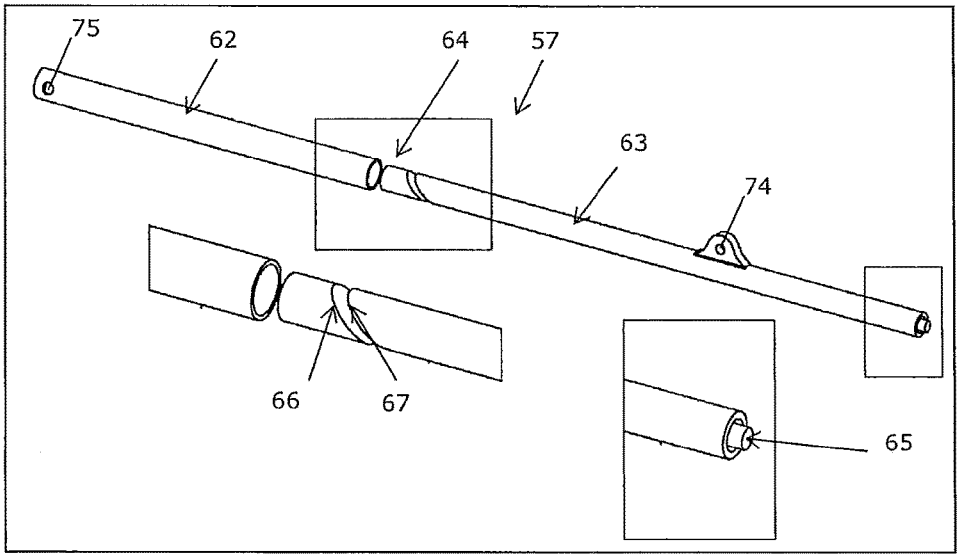
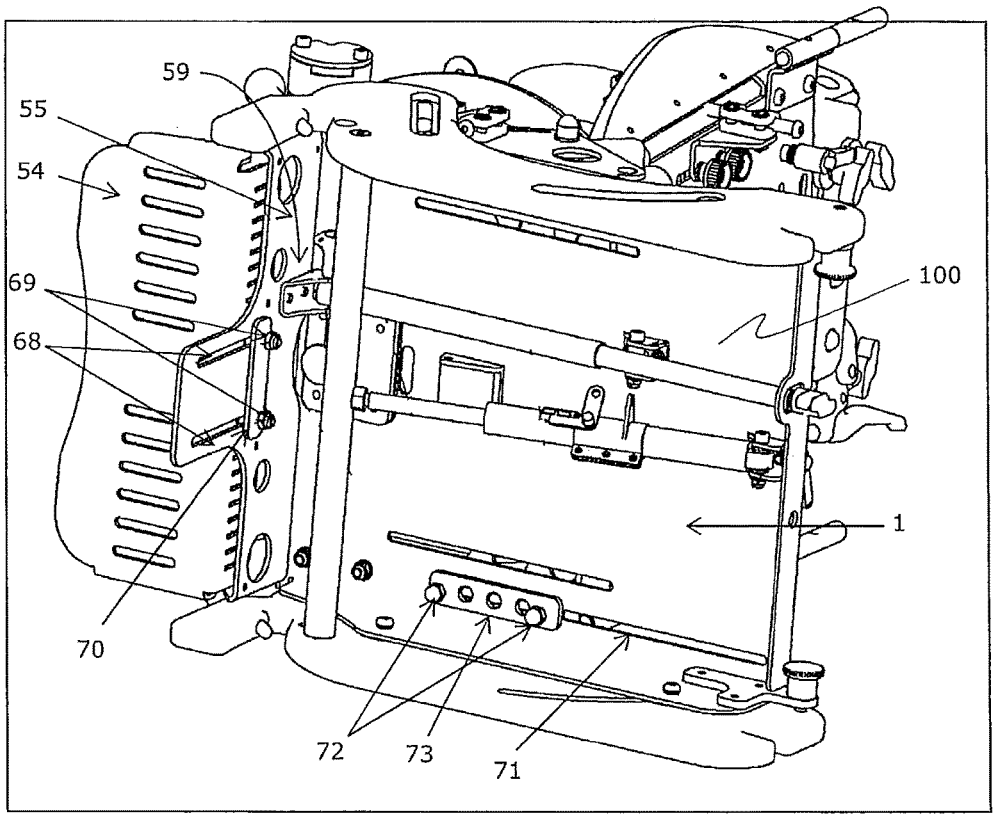
Figure 12

BACKREST ANGLE ADJUSTMENT SYSTEM ON A SEAT FOR A PHYSICALLY DISABLED PERSON

This application is a National Stage Application of PCT/NZ2014/000018, filed 18 Feb. 2014, which claims benefit of Serial No. 607283, filed 18 Feb. 2013 in New Zealand, Serial No. 607284, filed 18 Feb. 2013 in New Zealand, Serial No. 607285, filed 18 Feb. 2013 in New Zealand and Serial No. 607286, filed 18 Feb. 2013 in New Zealand and which applications are incorporated herein by reference. To the extent appropriate, a claim of priority is made to each of the above disclosed applications.

FIELD OF INVENTION

The invention relates to a seat for use by a physically disabled person.

BACKGROUND

Many people with severe physical disabilities need to use seats, such as wheelchairs or pushchairs (in the case of young children) for long periods of time. To provide a seat that can be used by people having different physical disabilities and who may need to recline in the seat at various times, it is necessary to provide a seat that can be adjusted to a user's needs.

It is an object of the invention to go at least some way towards providing a seat that can be adjusted to suit at least some physical support needs of the user, or to at least provide a useful alternative to existing seats.

SUMMARY OF THE INVENTION

According to a first aspect, the invention provides a seat comprising: a base frame; a seat base that is supported by the base frame; a backrest that is pivotally attached to the base frame at the rear of the seat base to allow the backrest to tilt forward and backward; and a backrest angle adjustment system. The backrest comprises a backrest support and an angle adjustment system comprises a vertically extending angle adjustment slot located centrally on the backrest support and further comprises an angle adjuster located on a rear surface of the backrest and that is adapted to slide along the angle adjustment slot. The backrest angle adjustment system also comprises a linkage that is pivotally attached to the seat frame and to the angle adjuster. The angle adjuster comprises a lock with a projection that projects through the angle adjustment slot of the backrest and is adapted to slide along the angle adjustment slot. The lock also comprises a fastener that engages with the projection to secure the position of the projection within the angle adjustment slot of the backrest.

Preferably, the backrest angle adjustment system further comprises one or more guides that engage with the angle adjuster for guiding the position of the angle adjuster substantially centrally along the angle adjustment slot as the projection slides along the angle adjustment slot.

Preferably, the backrest angle adjustment system comprises a pair of guides, one guide being located on either side of the angle adjustment slot. The backrest angle adjustment system further comprises a stop located at an upper end of the angle adjustment slot. The stop is attached to the rear of the backrest and is adapted to abut the angle adjuster when the backrest is in a position of maximum recline.

Preferably, the linkage comprises a pair of arms, each arm comprising an upright member and a substantially horizontal member, wherein the upright members of the arms are located substantially centrally along the rear of the backrest and the horizontal members of the arms are located near the sides of the backrest and at the bottom of the backrest.

In another preferred form, the backrest angle adjustment system further comprises a quick release pin that projects from the angle adjuster and through an upright locking aperture located in the backrest support to lock the backrest in an upright position.

In another aspect, the invention provides a seat comprising: a base frame; a seat base that is supported by the base frame; a backrest; and a tilt adjustment mechanism comprising a pair of side supports, each side support comprising at least one curved guide slot, wherein a side support is attached to each side of the base frame by guide bearings that extend from the base frame and through the guide slot, the guide supports being adapted to slide along the guide slot to adjust the tilt of the seat, and wherein the tilt adjustment system also comprises a lock to lock the seat at the desired angle of tilt.

Preferably, the tilt adjustment mechanism further comprises a linear actuator adapted to increase and decrease its length upon activation of an actuator switch that is connected to the linear actuator.

Preferably, the tilt adjustment mechanism further comprises a quick release lock for locking the seat in an upright position.

Preferably, the quick release lock comprises a locking pin attached to the base frame that projects through a lock aperture formed in an adjacent side support to lock the base frame in position relative to the side support.

Preferably, a quick release lock is located on each side of the base frame and on each side support.

In a first aspect, the invention provides a lateral support bracket comprising: a first portion extending in a first direction and comprising a first pivot joint to which a lateral support can be hingedly attached so as to rotate about a longitudinal axis of the first portion; a second portion extending at an angle from the first portion; and a third portion extending from the second portion in a second direction that is substantially opposite the first direction, wherein the third portion is adapted to attach the lateral support to a backrest of a seat.

Preferably, the third portion comprises a second pivot joint to attach the lateral support bracket to the backrest, wherein the second pivot joint is adapted so that the lateral support bracket is able to rotate about a longitudinal axis of the third portion.

Preferably, the third portion is able to slide forward and backward within the pivot bracket supporting the third portion.

In a second aspect, the invention provides a lateral support bracket comprising: a first portion extending in a first direction and to which a lateral support can be attached so as to rotate about a longitudinal axis of the first portion;

a second portion extending at an angle from the first portion; and a third portion extending from the second portion in a second direction that is substantially opposite the first direction, wherein the third portion is adapted to attach the lateral support to a backrest of a seat and wherein the third portion further comprises a pivot joint to attach the lateral support bracket to the backrest, wherein the pivot joint is adapted so that the lateral support bracket is able to rotate about a longitudinal axis of the third portion.

Preferably, the first portion comprises a pivot joint to which a lateral support can be hingedly attached so as to pivot about a longitudinal axis of the first portion.

In a third aspect, the invention provides a backrest having a lateral support bracket according to the first or second aspects of the invention.

Preferably, the backrest comprises a back support comprising a vertical slot through which the lateral support can project and also comprising a sliding bracket to which the lateral support is attached.

In a fourth aspect, the invention provides a seat comprising a backrest according to the third aspect of the invention.

In another aspect, the invention comprises a seat comprising: a base frame; a seat base supported by the base frame; and a footrest, wherein the footrest is able to pivot to form a storage position in which the footrest is inverted and is located above the seat base.

The angle of the footrest may be adjusted relative to the seat base by an actuator that is attached to the footrest and wherein the actuator can be activated from the rear of the seat.

Preferably, the seat further comprises a quick release system comprising a locking pin that projects through aligned apertures located in the footrest in the actuator to attach the footrest to the actuator and wherein the locking pin is adapted to be retracted from the aligned apertures to detach the footrest from the actuator.

Any reference to prior art documents in this specification is not to be considered an admission that such prior art is widely known or forms part of the common general knowledge in the field.

As used in this specification, the words "comprises", "comprising", and similar words, are not to be interpreted in an exclusive or exhaustive sense. In other words, they are intended to mean "including, but not limited to.

BRIEF DESCRIPTION OF DRAWINGS

Preferred embodiments of the invention will now be described by way of example and with reference to the accompanying drawings, in which:

FIG. 11 is a perspective side view illustrating a telescopic rod;

FIG. 12 is a further perspective view of the underside of the seat;

DETAILED DESCRIPTION

The invention relates to a seat that is suitable for use by a physically disabled person. The seat has a seat base on which a user can sit and a backrest that extends from the rear of the seat base at an angle. Certain aspects of the invention are particularly suitable for use in a portable seat for physically disabled children. The seat can be rested on a chair, couch, or any other supporting surface. The seat can also be attached to a wheelchair or to a specially adapted frame of a pushchair or to any other mobile or static bases.

Several advantageous features may be used with the seat, either alone or in combination with any two or more features. These features include: the ability of the backrest of the seat to tilt relative to the seat base; the ability of the backrest and seat base to tilt together so as to maintain the angle between the backrest and the seat base (this is referred to herein as the tilt in space mechanism); the attachment system used with lateral supports and the range of movement achievable by using that attachment system; and a footrest that is able to be adjusted to a variety of angles. Each of these features will be described in turn.

Tilting Backrest

Figure 1:
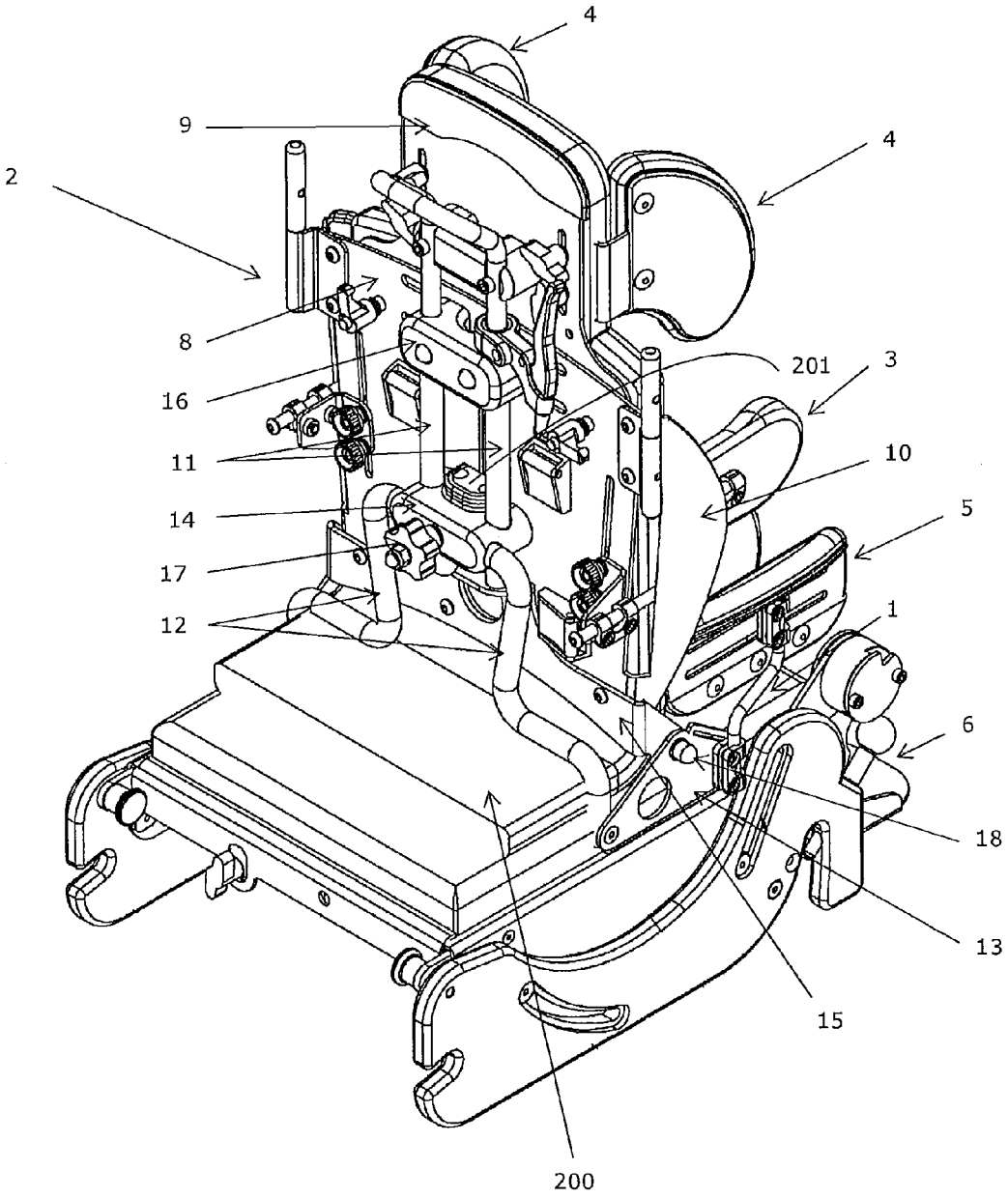
FIG. 1 is a perspective side view of a seat.

Referring to FIG. 1, and as described above, the seat comprises a base frame 200, which acts as a chassis to support a seat base 1 and a backrest 2. The base frame also houses parts of the tilt in space mechanism and the adjustment system used to vary the angle of the footrest relative to the seat base. The seat also comprises a backrest angle adjustment system.

The seat base is integral with the base frame and is a region located at the front of the base frame on which a person can sit. The seat base is optionally adapted to accept a cushion. The seat base has an upwardly facing contact surface on which a user can sit. The seat base is typically cushioned to provide comfort to a user.

The backrest 2 extends upwardly from the rear of the seat base 1 at an angle to the seat base. The backrest comprises a backrest support 8 and is pivotally attached to the base frame 200 to allow the angle between the backrest and seat base 1 to be varied.

In one form, as shown in FIG. 1, the base frame 200 comprises a pair of attachment brackets 13. One attachment bracket 13 is located on each of the left and right sides of the base frame. The backrest 2 also comprises an attachment bracket 15 located near the bottom of the backrest. A backrest attachment bracket may be positioned on each of the left and right sides of the backrest or a single backrest attachment bracket may extend across the bottom of the backrest, as shown in FIG. 1. In preferred forms, the backrest attachment bracket(s) is/are located on the rear of the backrest.

The base frame attachment brackets 13 and backrest attachment bracket(s) 15 are pivotally attached to each other at a pivot point 18 so that the backrest is able to pivot/tilt forward and backward between a substantially upright position and a reclined position.

Figure 2:
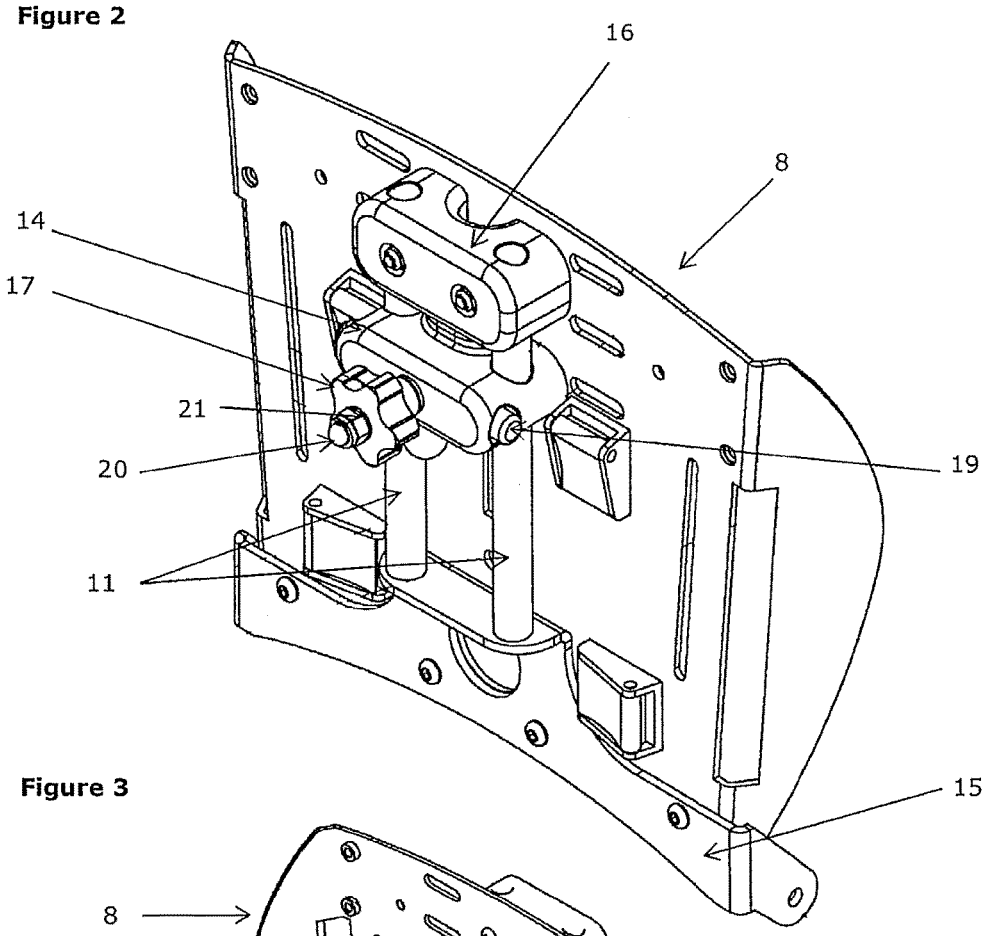
FIG. 2 is a perspective view of a lower backrest and backrest angle adjuster.
Figure 3:
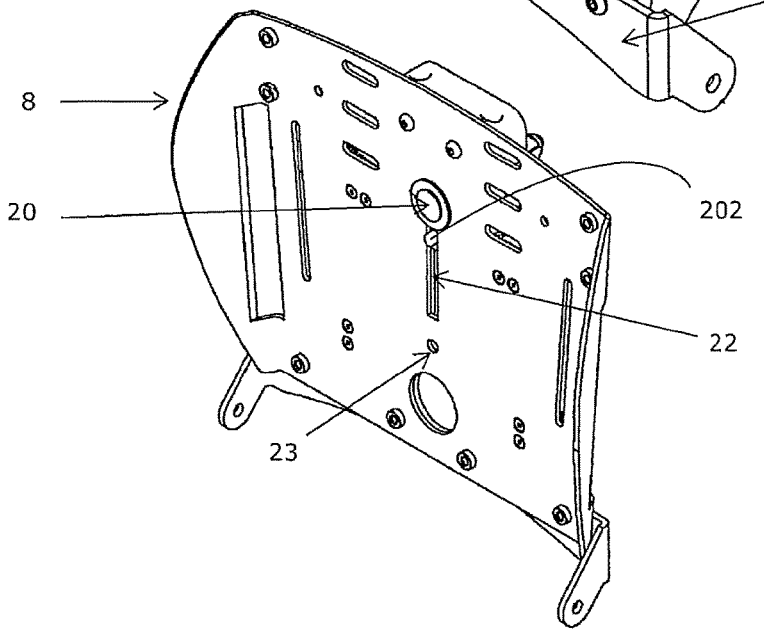
FIG. 3 is a reverse perspective view of the lower backrest and backrest angle adjuster.

The backrest angle adjustment system is used to vary the angle between the backrest and the seat base. The backrest angle adjustment system comprises an angle adjustment slot 22 that extends vertically along the a backrest support 8 of the backrest 2 and is located at or near the centre of the backrest support 8, as shown in FIGS. 1 to 3.

The backrest angle adjustment system also comprises an angle adjuster 14, which is located at the rear of the backrest support 8 and is adapted to slide along the angle adjustment slot 22. The angle adjuster 14 has a front face, which faces the rear surface of the backrest support, and a rear face, which faces away from the backrest support. A bore extends between the front and rear faces of the angle adjuster and is preferably centrally located on the angle adjuster. The interior of the bore has a threaded surface that is dimensioned to engage with a threaded locking pin 20 that is housed within the bore and that extends from both the front and rear faces of the angle adjuster.

The width of the angle adjustment slot 22 is greater than the diameter of the locking pin 20 so that a first end of the locking pin is able to project from the front surface of the angle adjuster 14 and through the angle adjustment slot 22. The first end of the locking pin terminates when it reaches the front surface of the backrest. A safety stop 20 is located at the first end of the locking pin and has a diameter or width that is greater than the width of the angle adjustment slot 22. The safety stop acts to prevent the locking pin from pulling out of the slot 22, as shown in FIG. 3. The safety stop 20 may be in the form of a flanged end, nut, or similar arrangement that holds the locking pin within the slot 22.

A second end of the locking pin projects from the rear surface of the angle adjuster and is attached to a fastener 17. The fastener comprises a threaded interior recess or bore that engages with the threaded locking pin. In the embodiment shown in FIGS. 1 and 2, the fastener 17 is in the form of a knob. A terminal stop 21, such as a nut, is preferably secured over the second end of the locking pin 20 to prevent the fastener 17 from the detaching from the pin.

In this arrangement, it is possible to lock the position of the backrest relative to the seat base. This is achieved by tightening the fastener against the angle adjuster by rotating the fastener in one direction so that the fastener moves toward the angle adjuster and clamps against the angle adjuster as tightly as possible. Because the fastener engages with the threaded locking pin, the locking pin is simultaneously pulled toward the fastener, causing the safety stop 20 to clamp against the front surface of the backrest support 8. When the fastener and safety stop are clamped firmly in position, the angle adjuster 14 and locking pin are prevented from sliding along the vertical angle adjustment slot 22 of the backrest. In this way, the backrest can be reclined to a desired angle and then secured in position.

Conversely, by loosening the fastener 17, the angle adjuster 14 and locking pin can slide along the vertical angle adjustment slot 22 until the backrest reaches the desired position. Once the backrest is in the desired position, the fastener can be tightened again to hold the angle adjuster and locking pin in position and to secure the position of the backrest.

To cause the backrest to tilt as the angle adjuster 14 slides along the angle adjustment slot 22, the angle adjuster is attached to the seat base by a linkage 12, as shown in FIG. 1. The linkage 12 is pivotally attached to the angle adjuster 14 at a connection point 19 and is also pivotally attached to the base frame 10.

In one form, as shown in FIG. 1, the linkage comprises a pair of arms 12. One end of each arm is pivotally attached to a respective base frame attachment bracket 13. The other end of each linkage arm is pivotally attached to a pivot bar that is attached to the angle adjuster 14 and forms a connection point 19, as mentioned above. The linkage is therefore able to pivot/tilt forward and backward toward the front and rear of the seat respectively as the angle adjuster slides up and down the angle adjustment slot 22.

In one form, each arm 12 of the linkage is angular and is preferably shaped to provide an upright member and a substantially horizontal member. The arms 12 are arranged so that the upright members are located at the central region of the backrest 2 and the substantially horizontal members are positioned toward the outer sides of the backrest, as shown in FIG. 1. In this arrangement, the linkage is less likely to interfere with working parts located along the sides of the rear of the backrest.

Because the angle adjuster is attached to the base frame by the linkage, as the angle adjuster slides upward along the vertical angle adjustment slot, the linkage pulls the angle adjuster downward toward the base frame. In this way, sliding the angle adjuster upwardly along the angle adjustment slot causes the backrest to recline toward the rear of the seat. Conversely, as the angle adjuster slides down the angle adjustment slot, the backrest is caused to pivot/tilt forward toward the upright position.

The angle of the linkage 12 in relation to the base frame substantially mirrors the angle of the backrest 2 in relation to the base frame.

The extent of forward tilt of the backrest can be limited by the length of the angle adjustment slot and the height of the linkage. The height of the linkage shown in FIG. 1 is defined by the distance between the end of the linkage arm 12 that is attached to the base frame attachment bracket 13 and the end of the linkage arm that is attached to the angle adjuster 14. In one form, the seat is adapted so that the minimum angle between the backrest and seat base is 90°.

To help the angle adjuster to slide smoothly along the angle adjustment slot without twisting or being pulled off centre, the backrest angle adjustment system optionally comprises a pair of guides that extend along either side of the vertical slot 22, as shown in FIGS. 1 and 2. Each guide projects through a respective bore in the angle adjuster. The bores and guides are dimensioned so that each guide can slide within the respective bore as the angle adjuster slides along the vertical angle adjustment slot 22.

Although it is preferred to use a pair of guides, it is envisaged that only one guide may be used instead. In this form, the guide would be centrally located along the rear of the backrest. In other forms, three or more guides may be used. In each form, the angle adjuster comprises a bore sized to allow a respective guide to slide within the bore as the angle adjuster slides along the angle adjustment slot.

Furthermore, although it is preferred for the guides to be centrally located along the rear of the backrest support, it is envisaged that the guides may be located in other positions, such as along the outer edge of the backrest.

It is important for the angle adjuster to stop at the upper end of the vertical adjustment slot without risking damage to the moving parts of the backrest angle adjustment system and without interfering with or damaging other parts attached to the rear of the backrest. To minimize the risk of damage and interference, a slider stop 16 may be attached to the rear of the backrest at the upper end of the vertical angle adjustment slot. In this arrangement, as the angle adjuster 14 reaches the upper end of the angle adjustment slot 22, the angle adjuster will abut the slider stop 16.

In another form, as shown in FIGS. 1 and 2, the angle adjuster 14 comprises an upper surface on which a separator 201 is positioned. In this form, the separator 201 abuts a lower surface of the slider stop 16 when the angle adjuster 14 reaches the upper end of the angle adjustment slot 22. The separator dampens the impact when the angle adjuster contacts the stop.

In one form, the backrest angle adjustment system also comprises a quick release pin 202 that has a first end that projects from the front face of the angle adjuster. When the backrest is in the upright position, the quick release pin projects through an upright locking aperture 23 formed in the backrest support 8 to lock the backrest in the upright position. The quick release pin has a second end comprising a handle, gripping portion, or ring by which a user can pull the quick release pin away from the backrest to disengage the pin from the aperture 23. Once the pin is disengaged, the angle adjuster is able to slide along the angle adjustment slot so that the backrest can recline to the desired position. Therefore, where the angle adjustment system comprises a quick release pin, it is not necessary to tighten the fastener of the angle adjuster when the backrest is in the upright position.

When the backrest is reclined, the quick release pin 202 extends through the angle adjustment slot 22, as shown in FIG. 3. To return the backrest to the upright position, the angle adjustment fastener 17 is loosened and the quick release pin is pulled to retract the pin from the angle adjustment slot 22. The backrest 2 is then pushed into the upright position and the quick release pin is released to engage with the upright locking aperture 23.

Advantages

The tilting backrest of the invention provides a way of quickly and easily adjusting the angle of the backrest with respect to the seat base. The ease of movement is further improved when the backrest angle adjustment system comprises a quick release pin ad upright locking aperture, as described above.

The tilting backrest is also advantageous because the moving parts of the angle adjustment system are centrally located at the rear of the backrest. This allows the sides of the rear of the backrest to be used to add other features to the seat. For example, the sides of the rear of the backrest shown in FIG. 1 comprise a positioning system for lateral supports.

Tilt in Space Mechanism

The seat of the invention may comprise a tilt in space mechanism that allows the seat base and backrest to tilt together so that the angle between the seat base and backrest remain the same.

Figure 4:
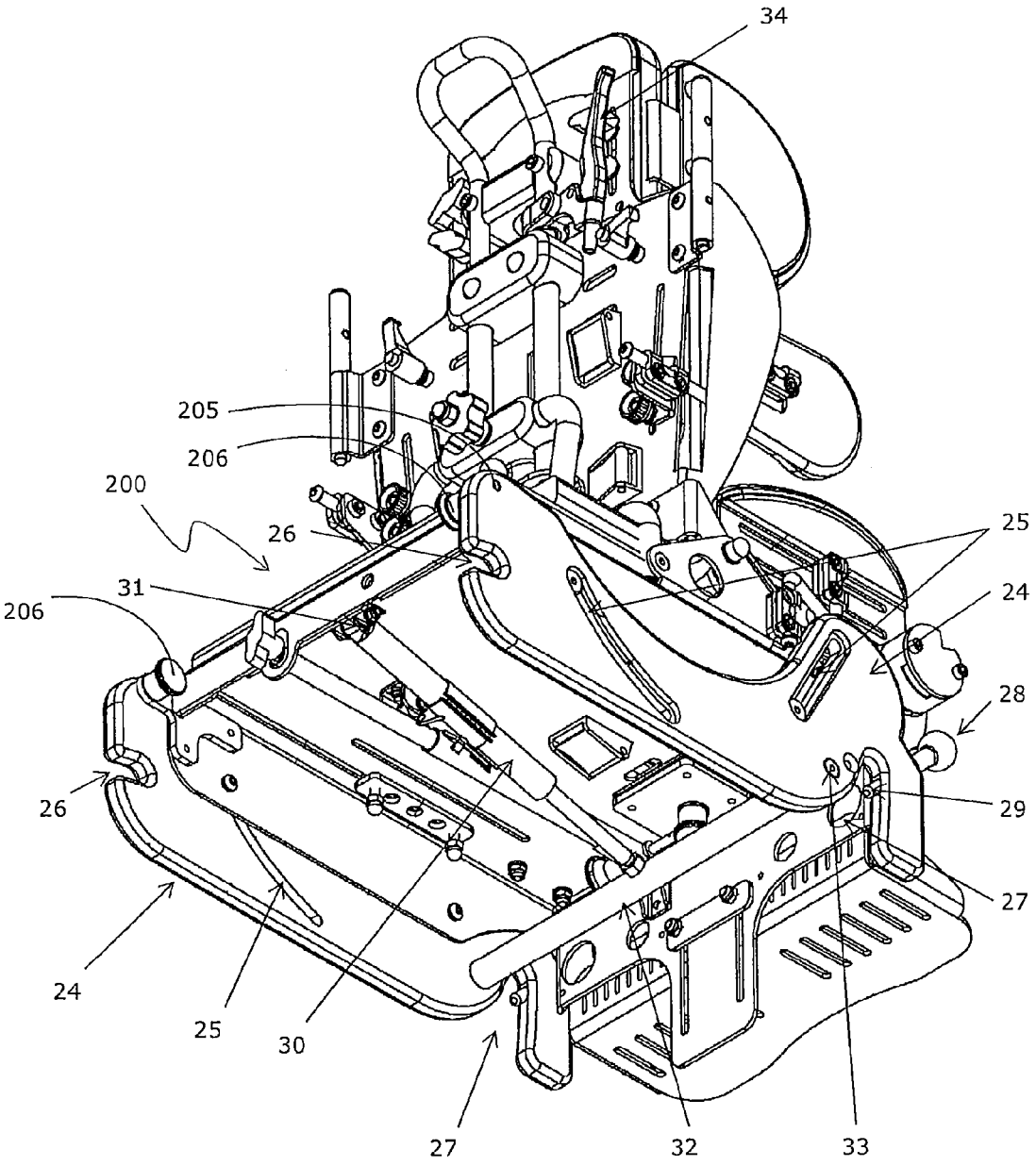
FIG. 4 is a perspective view of the underside of the seat.

In one form, the base frame 200 of the seat is attached to two side supports 24. Each side support 24 comprises at least one curved guide slot 25 to guide the tilting movement of the seat. In another form, each side support also comprises a substantially straight diagonal guide slot 25, as shown in FIG. 4. In this form, the curved guide slot is located toward the rear of the base frame and the diagonal guide slot is located toward the front of the base frame. The diagonal guide slot is inclined toward the front of the base frame and seat. This arrangement of slots typically allows the seat to tilt at an angle of around 40°.

The side supports 24 are attached to the base frame 200 by guide bearings that project from the base frame and through the guide slots 25. Each guide bearing comprises a shaft having a terminal stop located on each end of the shaft. The terminal stop may be a flanged end of the shaft, a bolt head, nut, or any other attachment that has a width wider than the width of the guide slot so that the guide bears are prevented from retracting from the respective guide slot. In this way, each guide bearing can slide along the respective guide slot but cannot disengage from the guide slot.

The seat further comprises a tilt actuation system that, when activated, causes the seat (comprising the base frame, seat base, and backrest) to tilt backward or forward without adjusting the angle of the backrest in relation to the seat base.

The tilt actuation system comprises a lock in the form of a linear actuator 30 that is able to increase and decrease its length. In one form, as shown in FIG. 4, the linear actuator is a self-locking telescopically extending mechanically, electrically, or gas powered linear actuator that is positioned beneath the base frame of the seat.

A first end of the linear actuator 30 is attached to a supporting pivot bar 32 that extends between the side supports 24 and is attached to the side supports by fasteners 33. The supporting pivot bar is able to rotate along its longitudinal axis.

An opposing second end of the linear actuator is attached to the base frame. In one form, as shown in FIG. 4, the second end of the linear actuator is attached to a rear plate of the base frame by a rear pivot bracket 31 that allows the linear actuator to pivot up and down about the bracket. The rear plate extends between the side supports at the rear of the base frame.

The tilt actuation system also comprises an activation switch 34 that allows the actuator to increase and decrease its length so that the seat can be tilted to the desired position. In the embodiment shown in FIG. 4, the activation switch is a lever that is connected to the actuator by a Boden cable (not shown) or other suitable means.

The activation lever is located on the rear of the backrest and near the top of the backrest for easy accessibility. However, in other embodiments, the activation lever 34 and/or the extendable actuator 30 may be located in a different position.

To change the tilt of the seat, the activation lever 34 is turned on (such as by pulling down on the lever), which unlocks the extendable linear actuator 30, enabling the actuator to change in length. As the length of the actuator changes, the base frame is caused to tilt, which causes the seat base and backrest (that are attached to the base frame) to tilt simultaneously.

The base frame 200 is guided though the tilting motion by the guide bearings that slide along the guide slots 25 in the side supports 24 as the actuator changes in length.

Once the desired angle of tilt is reached, the activation lever 34 is turned off (such as by releasing the lever). As soon as the activation lever is turned off, the actuator 30 stops adjusting its length and locks its position, which in turn locks the angle of tilt of the seat.

In one form, the tilt actuation system may comprise a safety lock mechanism that locks the seat in an upright position, regardless of whether or not the activation switch is turned on. The safety lock mechanism comprises a locking aperture 205 located in each side support and a spring loaded locking pin 206 located on each side of the base frame. Each locking pin projects through the respective locking aperture to lock the seat in the upright position.

The locking aperture and locking pin may be shaped so that the locking pin can only project through the aperture in a certain orientation. For example, the locking aperture may be a slot and the locking end of the locking pin may be the same shape as the slot so that when the locking pin and slot are aligned, the pin can project through the slot. Conversely, it is possible to retract the locking pin from the locking aperture by pulling the pin away from the aperture. The locking pin can then be rotated 90° so that it adopts an unlocked position in which the spring loaded pin is prevented from projecting through the locking aperture because the shape of the locking pin is not aligned with the shape of the locking aperture.

In one form, each side support 24 also comprises a rear recess 26 and a forward recess 27. The rear recess is located at a rear edge of the side support so that the rear recess faces backwards in relation to the seat. The rear recesses 26 are located in the same position on each side support so that the rear recesses are horizontally aligned at opposite sides of the rear of the base frame and behind the backrest 2, as shown in FIG. 4.

The front recess 27 is located on a lower edge of the side support and near the front of the seat. The front recesses 27 of the side supports 24 face downwardly with respect the seat. The front recesses are located in the same position on each side support so that the front recesses are also aligned, as shown in FIG. 4.

These recesses 26, 27 in the side supports 24 allow the seat to be fitted to a support frame (not shown), such as the frame of a specially adapted pushchair.

A spring loaded locking pin 29 projects at least partially through each front recess and forms an obstruction within the respective recess. A gap is provided between the locking pin and the closed end of the front recess.

The locking pin comprises a handle 28, which may be a gripping surface, knob, ring, or the like by which a user can pull on the locking pin to substantially retract the locking pin from the front recess. In the embodiment illustrated in FIG. 4, the handle is a knob 28.

To enable the seat to be locked to the support frame of a specially adapted pushchair or any other type of mobile or static bases, the handles 28 are pulled away from the front recesses and the locking pins 29 retract so as to no longer obstruct the front recesses. The seat is then fitted over cross bars of the support frame so that one cross bar rests within the rear recesses 26 and another cross bar rests within the front recesses 27. By subsequently releasing each handle 28, the locking pins 29 project into the front recesses beneath the cross bar held within the recesses. Each locking pin traps the crossbar in the gap formed between the locking pin and the closed end of the respective front recess. In this way, the locking pin locks the seat to the cross bar.

Advantages

The tilt in space mechanism allows the seat of the invention to be tilted without adjusting the angle between the seat base and backrest. This is particularly useful where the person using the seat need the angle of the seat base to the backrest to remain the same but also requires the seat to be reclined (such as for sleeping or for a nappy change). For example, the ability to recline a seat without changing the angle between the seat base and backrest is particularly important for users with cerebal palsy because the optimum angle of 95° between the set base and backrest can be maintained. Children with cerebal palsy are more likely to suffer spasms if they are not seated at this angle.

Where the seat also comprises a safety lock mechanism, the seat is prevented from tilting backward when someone or something accidentally activates the actuation switch.

Lateral Supports

In another form, the seat of the invention may comprise one or more lateral supports that are attached to the backrest by a lateral support positioning system. The lateral support positioning system allows for adjustment of the height at which the lateral supports are attached to the backrest. The lateral support positioning system also allows for adjustment of the extent to which the lateral supports project from the front of the backrest (the forward reach of the lateral supports). In addition, the lateral support positioning system allows for adjustment of the distance between the lateral supports and also allows the angle of tilt of the lateral supports to be adjusted.

Lateral supports are important to provide support and stability to the torso of a person using the seat. Lateral supports help a person with postural support needs to sit in an upright position without slouching over forward and without tipping sideways. Different users will have different support needs, so it is important to be able to attach one or more lateral supports to the backrest of the seat in a way that allows for the positioning of the lateral support(s) to be adjusted.

As shown in FIGS. 5 to 8, the invention provides a lateral support bracket 43 comprising a first portion 301 extending in a first direction, a second portion 302 extending at an angle from the first portion, and a third portion 303 extending from the second portion in a second direction that is substantially opposite the first direction.

Figure 6:
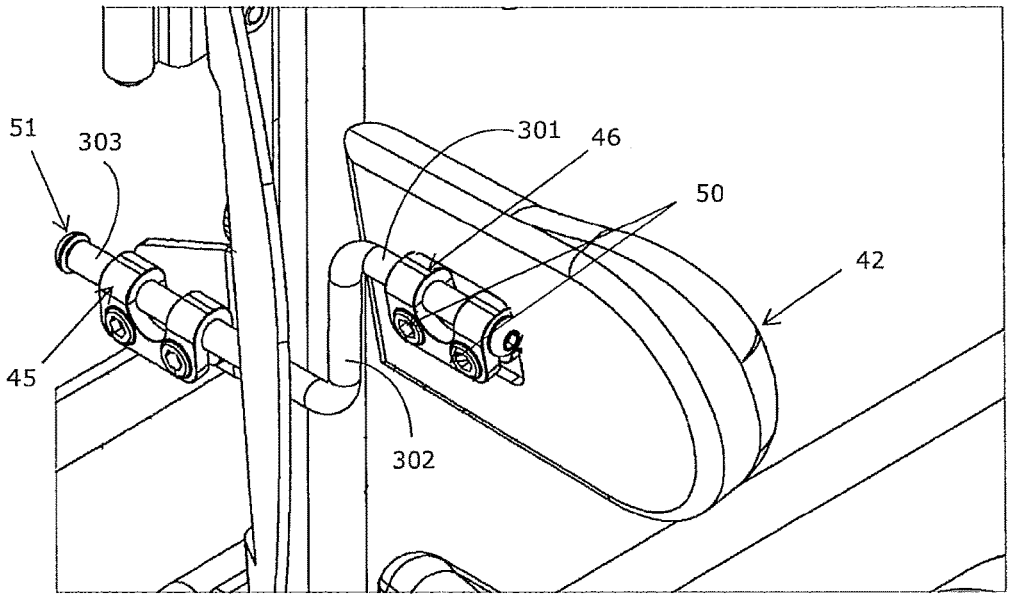
FIG. 6 is a perspective side view of the lateral support.

In one form, the first portion 301 of the lateral support bracket 43 is able to be hingedly attached to a lateral support 42 by a first pivot joint 46, as shown in FIG. 6. The pivot joint comprises an aperture within which the first portion of the lateral support bracket is held. The pivot bracket aperture and the first portion 301 are dimensioned so that the first portion can rotate about its longitudinal axis within the pivot bracket. The ability of the first portion to rotate means that the lateral support can be tilted to face upward, downward or sideways to suit the individual needs of a user of the lateral support. For example, where a user tends to slouch forward, it is helpful to tilt the lateral support upwards to contact the user's torso and encourage the user to sit upright.

The second portion 302 acts to distance the first portion 301 from the third portion 303 of the lateral support bracket so that by rotating the lateral support bracket 51 along the longitudinal axis of the third portion, it is possible to adjust the position of the lateral support 42 with respect to the backrest. For example, by rotating the lateral support bracket, it is possible to move the lateral support closer to the centre of the backrest or further away. This means that distance between two lateral supports (one located on each side of the backrest) can be adjusted to suit the size of torso of the user.

In one form, the second portion of the lateral support bracket extends between the first and third portions at right angles, but it is envisaged that the second portion may extend from the other two portions at any suitable angle.

Figure 5:
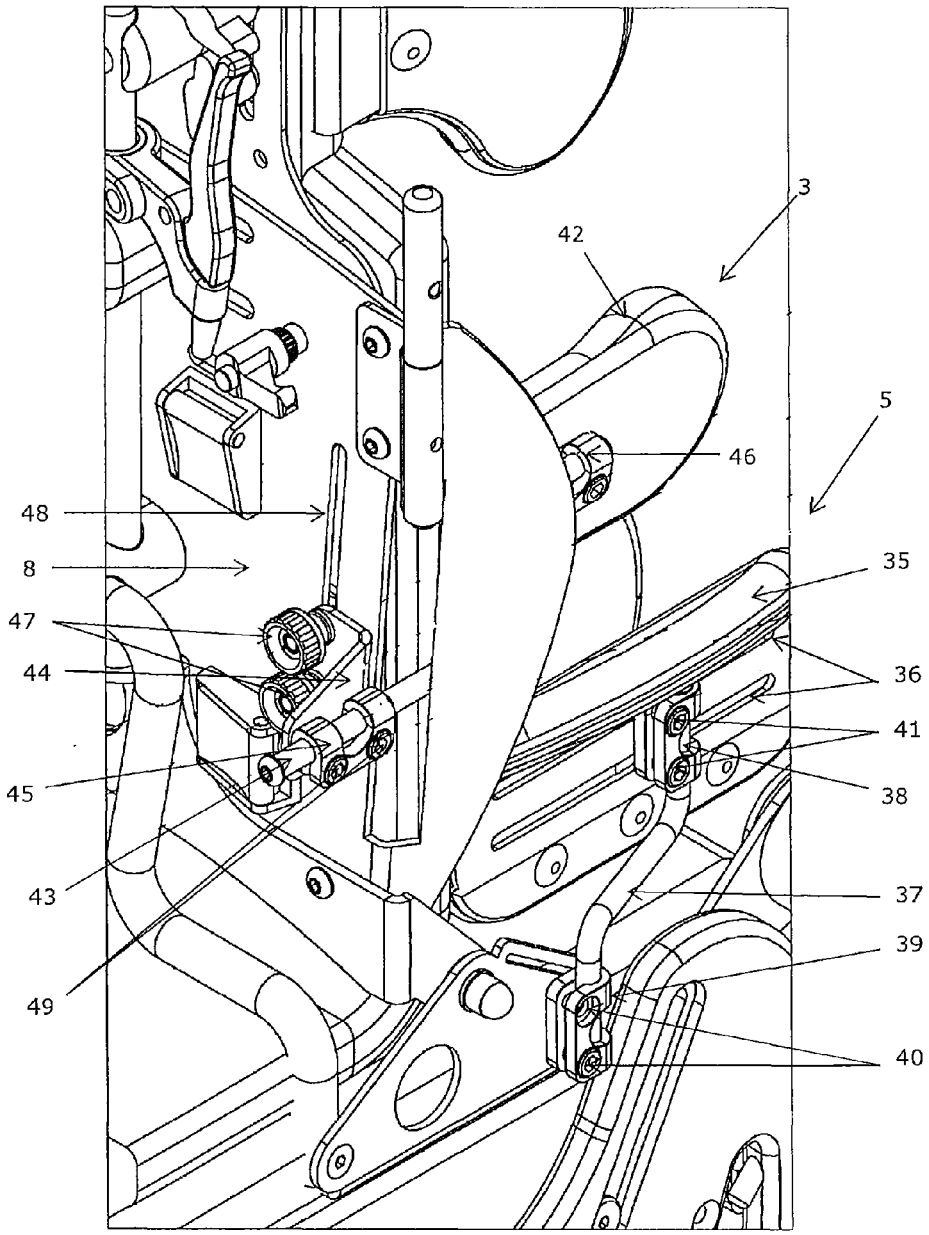
FIG. 5 is a perspective view showing a lateral support and a hip support.
Figure 7:
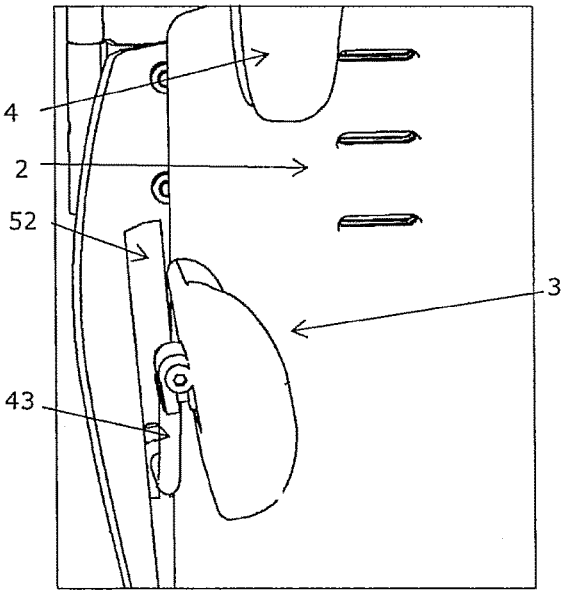
FIG. 7 is a front view of the lateral support and a lateral head support.

The third portion 303 of the lateral support bracket is adapted to attach the lateral support to the backrest of a seat. In one form, as shown in FIGS. 5 to 7, the third portion 303 extends through a slot 52, which may formed in the side of the backrest support 8 or the slot may be provided between a side support and the backrest support. In this arrangement, the first and second portions of the lateral support bracket project from the front of the backrest support and the third portion projects from the rear of the backrest support.

In one form, the lateral support bracket is attached to the rear of the backrest by a pivot bracket 45. The pivot bracket comprises an aperture within which the third portion of the lateral support bracket is held. The pivot bracket aperture and the third portion 303 are dimensioned so that the third portion can rotate about its longitudinal axis within the pivot bracket to vary the distance of the lateral support from the centre of the backrest (and from an opposing lateral support, where a lateral support is attached to each side of the backrest).

The extent to which the lateral support projects from the front face of the backrest can also be adjusted by sliding the third portion 303 of the lateral support bracket forward or backward within the pivot bracket 45.

The pivot bracket 45 is mounted on a slider bracket 44 that is adapted to slide up and down a vertical slot 48 formed in the backrest support 8. The vertical slot provides a lateral support height adjustment slot 48.

In one embodiment, as shown in FIG. 5, the slider bracket is an angle bracket, although it is not necessary that the slider bracket takes this form.

The slider bracket 44 comprises one or more fasteners 47 that are able to secure the slider bracket in a desired position within the lateral support height adjustment slot 48.

In one form, each fastener comprises a clamping plate 53 from which a locking pin projects and is attached to a clamping actuator 47. The clamping plate 53 is positioned over the height adjustment slot 48 on the front face of the backrest support 8. A locking pin extends from the clamping plate and projects through the lateral support height adjustment slot 48. The free end of the locking pin is threaded and engages with a threaded annular recess of a clamping actuator 47. In the embodiment shown in FIG. 5, the clamping actuator is a knob 47.

The height of the lateral support can be adjusted by loosening the knob 47 to remove the clamping pressure on the backrest, caused by the clamping plate and clamping actuator. The slider bracket 44 is then slid along the lateral support height adjustment slot 48. As the slider bracket moves along the slot 48, the lateral support moves in the same direction. Once the lateral support is at the desired height, the fastener(s) can be secured by tightening the knob to clamp the knob and slider bracket against the backrest support 8.

The lateral support 3 optionally comprises padding 42.

The lateral support bracket 43, illustrated in FIGS. 5 and 6, is a round, substantially z-shaped bar. However, it need not be limited to this shape. The lateral support bracket can be made from metal such as steel or any other suitable material.

FIG. 7 shows a lateral support 3 and a lateral head support 4.

Figure 8:
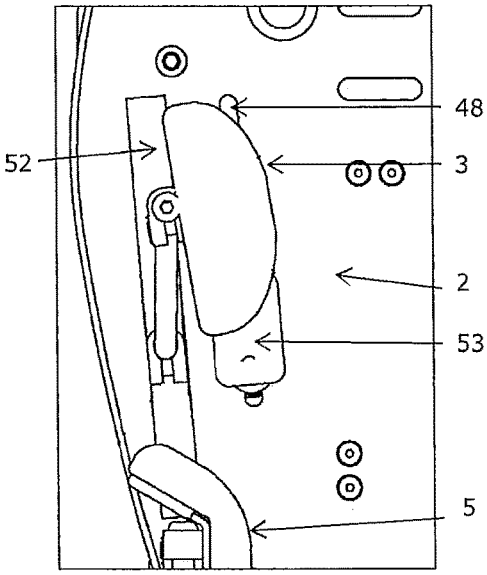
FIG. 8 is a front view of the lateral support.

Optionally, the seat also comprises hip supports 5 to help stabilise the sitting posture of a user, as shown in FIG. 8.

Optionally, the seat further comprises a pair of lateral head supports 4.

As shown in FIG. 5, the hip support 5 comprises hip support padding 35, two slots 36, a bar 37, a length bracket 38, and a width bracket 39. The bar 37 is connected to the width bracket 39, which is secured to the backrest attachment bracket 13 with fasteners 40.

The opposite end of the bar 37 is connected to the length bracket 38, which is connected to the hip support padding 35 with two fasteners 41. These fasteners 41 pass through the slots 36 and can be fastened against an inside surface of the hip support padding 35. The width of the hip support 5 can be adjusted by loosening the fasteners 40. This enables the bar 37 to swing inwardly or outwardly. Once the desired width is reached, the fasteners 40 can be re-tightened.

The length position of the hip support 5 can also be adjusted by loosening fasteners 41, which allows the hip support padding 35 to move back or forth with respect to the bar 37. Once the desired length position is reached, the fasteners 41 can be re-tightened.

Advantages

The lateral support adjustment bracket and the way in which the bracket is attached to the backrest of a seat allow the position of the lateral support that is attached to the bracket to be adjusted to suit the needs of a user of the lateral support. In particular, the lateral support can be tilted to face upwardly, downwardly, or sideways. The lateral support can be moved closer to the centre of the backrest or further away to suit the needs of users having slim torsos and those having broad torsos. The height of the lateral support can be adjusted and the extent to which the lateral support projects from the front face of the backrest can also be adjusted.

Footrest

Another embodiment of seat according to the invention relates to a footrest 6 comprising a footplate 54, on which a user of the chair can rest their feet, and a spacer 55 that attaches the footplate to the seat base 1. The footrest 6 is connected to a tilt adjustment system 100 that adjusts the angle of the spacer with respect to the seat base so that the footrest can adopt many different positions.

The footplate 54 is dimensioned to support a user's feet. The footplate 54 attaches to the spacer 55 and is able to slide up and down the spacer to vary the distance of the footplate from the seat base. With this range of adjustment, the footrest is able to accommodate different users having different leg lengths and is also able to accommodate the changing leg lengths of a user who is a growing child.

Figure 9:
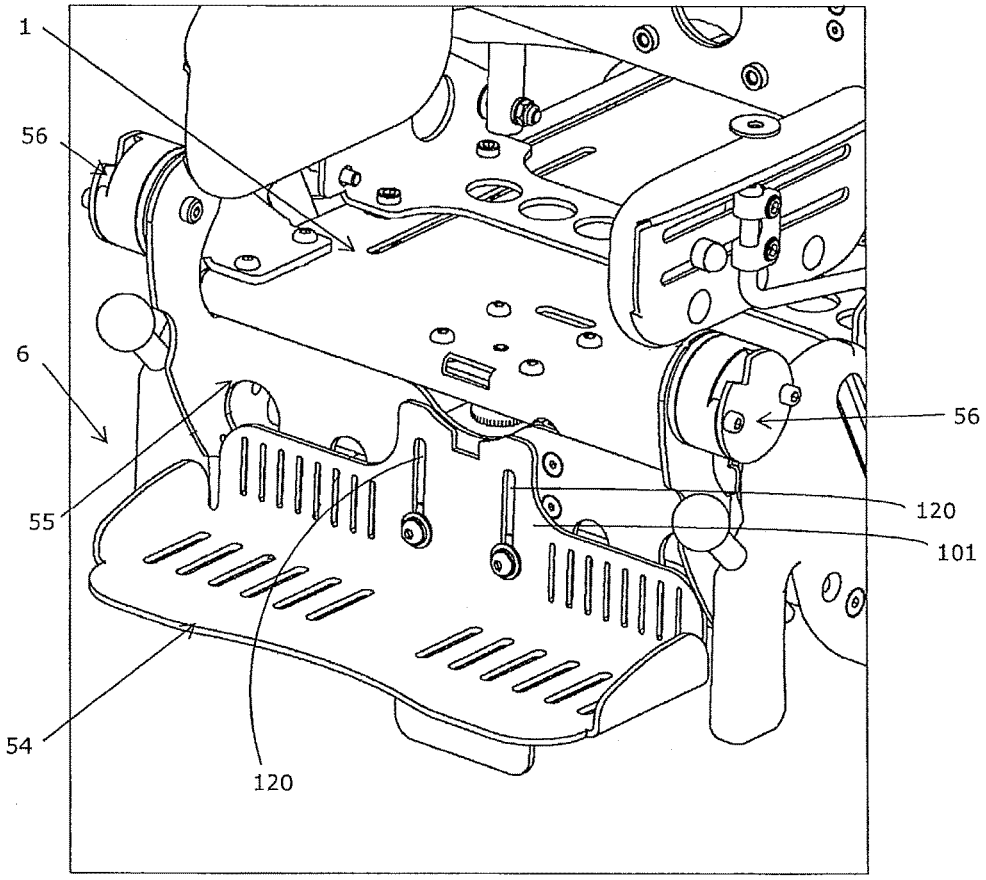
FIG. 9 is a perspective front view of part of the seat.

The spacer 55 is either directly or indirectly attached to either the seat base 1 or base frame 200 via a hinged joint 56 and is able to pivot up and down with respect to the seat base by pivoting about the axis of the hinged joint 56. In one form, a hinged joint 56 is attached at each side the seat base 1 and to each side of the spacer 55, as shown in FIG. 9. The hinged joint 56 provides a pivot point for the footrest 6.

Because the footrest 6 is able to pivot up and down to vary the angle of tilt of the footplate 54 with respect to the seat base 1, the footplate is able to be positioned in a neutral position in which the footrest projects below the seat base. In the neutral position, the spacer projects substantially perpendicularly to the seat base and the footplate is at a height below the height of the seat base in relation to the ground and the plane of the footplate is substantially parallel with the plane of the seat base, as shown in FIG. 13.

Figure 13:
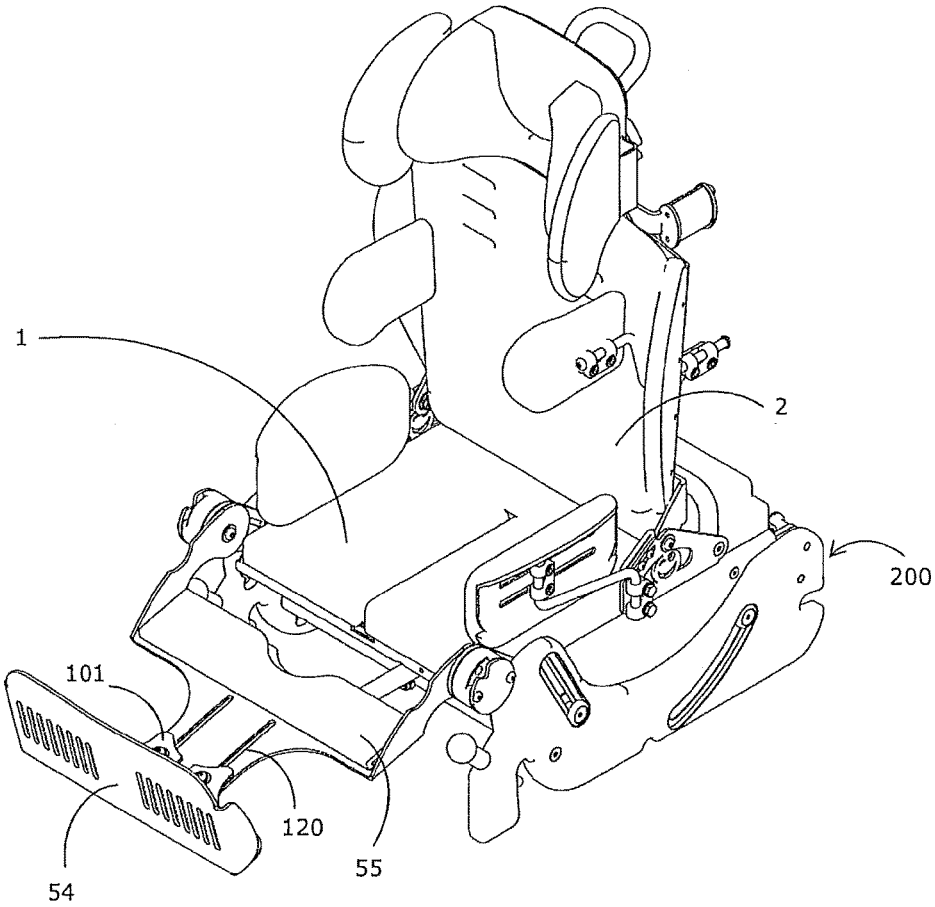
FIG. 13 is a perspective view showing the footrest in the extended position.

The tilt adjustment system 100 of the footrest engages with the spacer 55 and allows the footplate 54 and spacer 55 to pivot upward to form an extended position in which the footplate lies in a plane that is substantially vertical to the plane of the seat base and the space lies in a plane that is substantially parallel to the plane of the seat base, as shown in FIG. 13. The footrest can also take any position in between the neutral position and the extended position. In each of these positions, the footrest can be locked in position.

Figure 14:
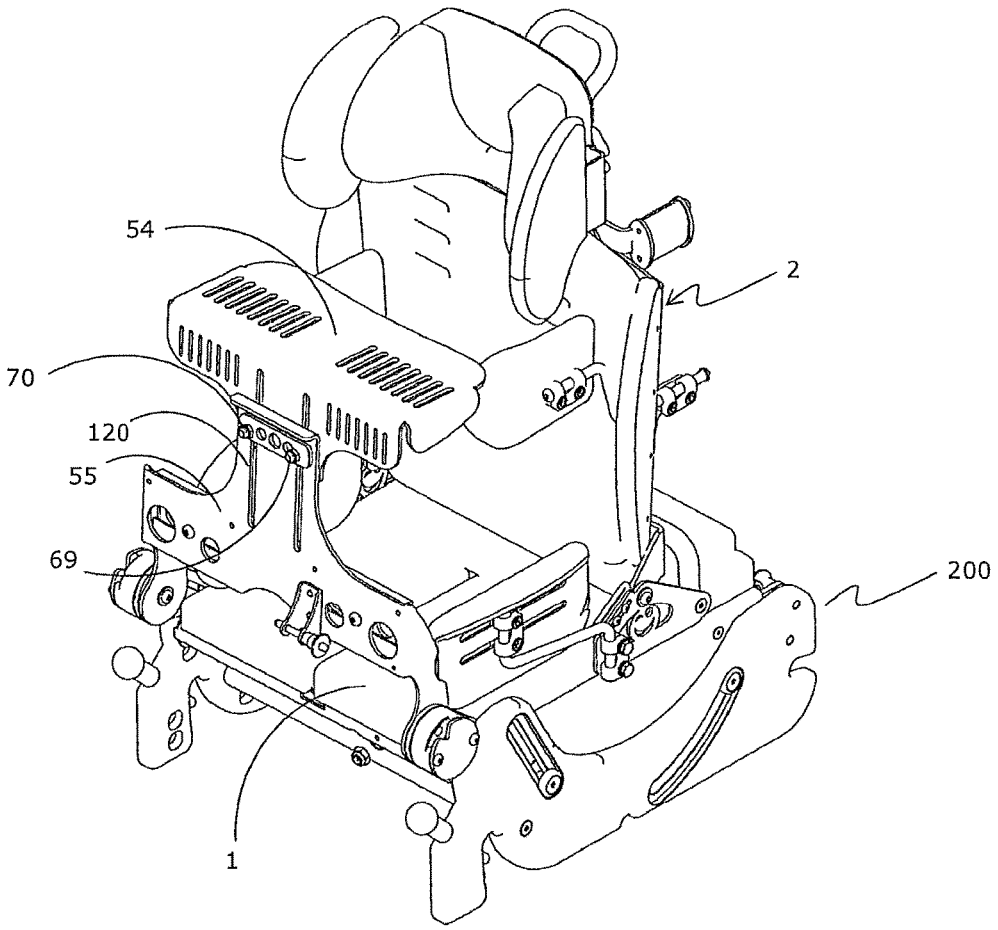
FIG. 14 is a perspective view showing the footrest inverted in the storage position.

The tilt adjustment system of the footrest can also be disconnected from the spacer 55 to allow the footplate 54 and spacer 55 to pivot freely about the axis of the hinged joint 56. With this range of movement, the spacer 55 can be rotated substantially 180° so that the footplate 54 is in a substantially inverted position, referred to in this specification as the storage position, as shown in FIG. 14. In the storage position, the footplate is at a height from the ground that is above the height of the seat base and the contact surface of the footplate (being the surface on which a user would rest their feet when using the footrest) faces the seat base. In this arrangement, the footrest is pivoted/folded upwards to reduce the overall height of the seat. By folding the footrest out of the way, the seat can be stored (such as in the boot of a car) without the footrest getting in the way and to minimise the risk of damage to the footrest.

One form of footrest according to the invention is shown in FIG. 9. The footrest 6 comprises a footplate 54 that is attached to a spacer 55, as described above, via an attachment bracket 101.

The attachment bracket 101 is connected to a rear edge of the footplate at a right angle. Other angles of attachment could be used instead, provided that the angle of the attachment bracket compliments the angle at which the spacer projects from the seat base so that the footplate lies in a plane that is substantially parallel to the plane of the seat base when the footrest is in the neutral position.

In one embodiment, as shown in FIG. 9, the footplate attachment bracket 101 and spacer 55 comprise a footplate height adjustment system that allows the footplate 54 to slide up and down the spacer 55 to adjust the distance of the footplate with respect to the seat base 1.

In one form, the footplate height adjustment system comprises a plurality of vertically extending slots 120 formed in the footplate attachment bracket 101 and corresponding vertically extending slots 68 formed in the spacer 55. Preferably, two slots are formed in the footplate attachment bracket and in the spacer. The respective slots 120, 68 of the attachment bracket 101 and spacer 55 are positioned to align with each other when the footplate attachment bracket 101 abuts the front face of the spacer in the correct position. Fasteners project through the aligned slots to secure the footplate to the spacer.

In one form, as shown in FIG. 9, the fasteners are in the form of threaded nuts and bolts. A threaded bolt passes through a pair of aligned slots and is secured at each end by a nut to attach the footplate to the spacer. If the nuts are loosened, the footplate can be raised or lowered with respect to the seat base. The fasteners are able to slide along the respective slots as the distance between the footplate and the seat base is adjusted. When the desired distance is reached, the nuts are tightened to hold the footplate in position.

A clamping plate 70 is optionally placed on the rear surface of the spacer 55 between the nuts and the spacer to encourage the footplate attachment bracket to clamp firmly against the spacer.

Although the slots are illustrated as being vertical and in parallel, it is envisaged that the vertically extending slots may otherwise be angled outwardly or inwardly without departing from the scope of the invention.

In another form, the footplate attachment bracket comprises a plurality of vertically extending slots, as described above. A fastener, in the form of a nut and bolt arrangement, engages with each slot to secure the footplate to the spacer. Each fastener comprises a threaded bolt, one end of which projects from the spacer (either by being attached to the spacer or by extending through an aperture formed in the spacer) and the other end of which projects through a respective slot in the footplate attachment bracket. A nut is fitted over the free end(s) of the bolt to prevent the bolt from sliding out of the respective slot. In this arrangement, the footplate can slide toward (up) and away from (down) the seat base by loosening the nuts and allowing the bolts of the fasteners to slide along the slots. When the footplate reaches the desired distance from the seat base, the nuts are tightened to clamp the footplate to the spacer so that the position of the footplate is secured.

Conversely, a plurality of vertically extending slots may be formed in the spacer, as described above. Again, a fastener, in the form of a nut and bolt arrangement, engages with each slot to secure the footplate to the spacer. In this form, one end of each bolt projects from the footplate attachment bracket (either by being attached to the bracket or by extending through an aperture formed in the bracket) and the other end extends through the respective slot and is secured in place by a nut, as described above.

Although a nut and bolt arrangement has been described as forming the height adjustment system, it will be appreciated that other suitable arrangements could be used instead, provided that those arrangements allow the distance between the footplate and seat base to be adjusted and allow the footplate to be secured in position after the desired distance is reached.

As mentioned above, the footrest is connected to a tilt adjustment system that is positioned beneath the seat base 1. The tilt adjustment system comprises an actuator that engages with the spacer to push the spacer away from the actuator and to pull the spacer toward the actuator. When the actuator pushes the spacer away, the spacer is caused to pivot upwardly about the axis of the hinged joint 56. For example, if the footrest is in the neutral position and the actuator pushes the spacer away, the footrest will be caused to move from the neutral position and toward the extended position. Conversely, when the actuator pulls the spacer towards it, the spacer is caused to pivot downwardly about the axis of the hinged joint 56. For example, if the footrest is in the extended position and the actuator pulls the spacer towards it, the footrest will be caused to move from the extended position toward the neutral position.

Figure 10:
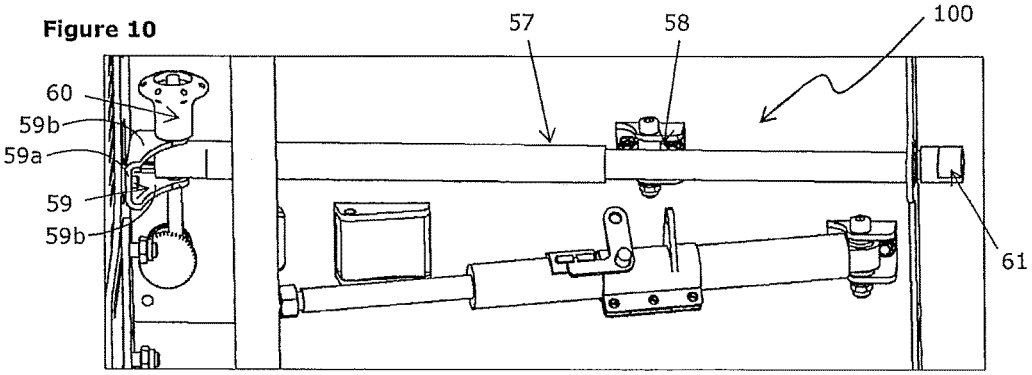
FIG. 10 is an underside view of part of the seat.

In one form, the actuator is a telescopically extending linear actuator 57, as shown in FIGS. 10 to 12. However, it will be appreciated that any form of actuator could be used instead, provided that the actuator is adapted to push and pull on the spacer. Typically, but not necessarily, this will be a linear actuator that is able to increase and decrease its effective length.

As shown most clearly in FIGS. 10 and 11, the telescopically extending linear actuator 57 comprises a sleeve 62, a shaft 63, a clamping section 64, and a central rod 65.

The shaft 63 is hollow and has a first end, an opposing second end, and a mid-section in between. The shaft 63 also comprises an attachment fitting 74 that projects from its exterior surface and by which the shaft is attached to a bracket 58 located on the lower surface of the seat base 1.

The central rod 65 is located within the hollow shaft 63. The central rod 65 has a diameter that is sufficiently less than the internal diameter of the hollow shaft 63 to allow a degree of slop between the central rod 65 and the interior of the hollow shaft 63.

The central rod 65 has a first end that extends from the first end of the shaft 63 and a second end that projects from the second end of the shaft 63.

The first end of the central rod 65 is threaded. A tilt adjustment controller in the form of a control knob 61 having a threaded interior surface engages with the first end of the central rod 65 so that rotating the knob 61 in one direction will cause the central rod 65 to move toward the knob 61 and rotating the knob 61 in the opposite direction will cause the central rod 65 to move away from the knob 61.

The tilt adjustment controller 61 is located at or near the rear of the seat so as to be readily accessible from the rear of the seat.

As shown in FIG. 11, the second end of the central rod 65 projects from the second end of the shaft 63 and attaches to the clamping section 64. The clamping section 64 comprises an exterior surface, a first end having a sloping face 66, and a second end. The second end of the shaft 63 also comprises a sloping face 67 that slopes at the same angle (preferably 45°) as the sloping face 66 of the clamping section 64 so that the two sloping faces 66, 67 can slide against each other. The exterior surface of the clamping section and the exterior surface of the shaft are generally aligned so as to be substantially flush when the actuator is in an unlocked position.

The sleeve 62 has a first end and an opposing second end. The sleeve encases the clamping section 64, the second end of the central rod 65, the second end of the shaft 63, and a portion of the mid-section of the shaft 63, as shown in FIGS. 10 and 12.

The second end of the sleeve 62 is adapted to attach the actuator 57 to the spacer 55. In one form, as shown in FIGS. 10 to 12, the rear surface of the spacer 55 comprises an actuator attachment bracket 59. In one form, this bracket 59 is a u-shaped bracket 59 comprising a base 59*a* and a pair of arms 59*b* extending from the base. The arms 59*b* of the bracket are sufficiently distanced apart to allow the second end of the sleeve 62 to fit between the bracket arms. An aperture (not shown) is located in each arm of the bracket 59 and an aperture 75 is also located in the second end of the sleeve. The second end of the sleeve 62 is positioned between the bracket arms 59*b* so that the aperture 75 in the second end of the sleeve aligns with both apertures of the bracket arms 59*b*. A quick release pin 60 projects through the aligned apertures to attach the actuator 57 to the spacer 55.

In another form, the actuator attachment bracket 59 is an angle bracket having one projecting arm with an aperture formed therein. The aperture 75 located on the second end of the sleeve 62 aligns with the aperture of the projecting arm of the bracket and the quick release pin 60 projects through the aligned apertures to attach the spacer 55 to the actuator 57, as described above.

The controller 61 activates the linear actuator and is used to control the angle of tilt of the footrest with respect to the seat base.

To lock the footrest in position, the control knob 61 is tightened by turning it in a particular direction. The threaded interior of the control knob engages with the threaded first end of the central rod 65 and causes the central rod 65 to project further from the first end of the shaft 63 and to move further into the threaded interior of the control knob 61. As the central rod moves further toward the control knob, the rod 65 pulls the clamping section 64 in the same direction. This movement of the clamping section 64 causes the sloping face 66 of the clamping section to abut the sloping face of the second end of the shaft 63. As the central rod 65 continues to move further into the interior of the control knob, the sloping face 66 of the clamping section is caused to slide against the sloping face 67 of the shaft 63. Because there is a degree of slop between the central rod 65 and the interior of the shaft 63, the sloping face 67 of the second end of the shaft 63 encourages the clamping section 64 to slide in the direction of the slope to some extent so that the exterior surface of the clamping section 64 no longer aligns with the exterior surface of the shaft 63. In other words, a portion of the exterior of the clamping section extends beyond the exterior of the shaft so that the actuator is in a locking position. In this position, the external diameter of the adjacent shaft and clamping section is greater than the external diameter of the shaft on its own. The expanded diameter of the shaft 63 and clamping section 64 cause these two parts 63, 64 to press against the interior of the sleeve 62 to lock the shaft in place, thereby locking the spacer (and footrest) in position.

Conversely, to adjust the angle of tilt of the footrest, the control knob 61 is loosened by turning it in the opposite direction, so that the central rod 65 is caused to pull away from the control knob 61 and the clamping section 64 is caused to move away from the shaft 63. As the clamping section moves away from the shaft, the exterior surfaces of the clamping section and shaft begin to align with each other again, so as to release the pressure on the interior of the sleeve 62. The spacer 55 can be pulled upward or downward to the desired position by hand and the sleeve 62 can side along the clamping section and shaft to adjust the length of the actuator to suit the position of the spacer. The quick release pin forms an axis about which both the spacer bracket can pivot as the length of the linear actuator extends. When the desired position is reached, the control knob is tightened again to secure the angle of the footrest and hold the footrest in position.

Using this arrangement, the actuator can be used to adjust and set the angular position of the footrest with respect the seat base to any angle between the neutral position and the extended position.

To move the footrest into the storage position, the quick release pin is removed from the spacer bracket 59 to detach the spacer from the actuator. The spacer can then be pulled upwardly and folded against the front edge of the seat base so that the footrest is in an inverted position. The quick release pin can be reinserted between the apertures in the spacer bracket and the actuator sleeve to reattach the spacer 55 to the actuator 57.

In other embodiments, the telescopic rod may be replaced with a lockable linear actuator.

The footrest of the invention may comprise the tilting adjustment system, the footplate height adjustment system, or both.

Advantages

The footrest of the invention offers several advantages, including the ability to easily adjust the angle of tilt of the foot rest with respect to the seat base. The ability to access the control knob from the rear of the seat also improves the ease of use of the tilt adjustment mechanism, particularly when the foot rest is used with a chair that rests on the frame of a pushchair. In such a situation, the front crossbar of the chair frame makes it very difficult to access a footrest adjustment mechanism located at the front of the footrest.

Another important advantage is the ability to place the footrest in the storage position where the footrest is inverted and folded out of the way. In this position, the seat can be placed on its base without the footrest being in the way and without risking damage to the footrest. The seat can also be stored more readily when the footrest is in the storage position because the outer dimensions of the seat are reduced.

Although the invention comprises been described by way of example, it should be appreciated that variations and modifications may be made without departing from the scope of the invention as defined in the claims. Furthermore, where known equivalents exist to specific features, such equivalents are incorporated as if specifically referred in this specification.

The invention claimed is:

1. A seat comprising:

a base frame;

a seat base that is supported by the base frame;

a backrest configured to tilt forward and backward relative to the seat base; and a backrest angle adjustment system comprising a vertically extending angle adjustment slot located on a support structure of the backrest and further comprising an angle adjuster, configured to slide along the angle adjustment slot, and a linkage system pivotally attached to the seat frame and to the angle adjuster;

wherein the angle adjuster comprises a lock configured to slide along the angle adjustment slot, and a fastener configured to secure the lock in position of a projection within the angle adjustment slot to lock the angle of the tilt of the backrest relative to the seat base.

2. The seat of claim 1, wherein the backrest angle adjustment system further comprises one or more guides that engage with the angle adjuster for guiding the position of the angle adjuster substantially centrally along the angle adjustment slot as the lock slides along the angle adjustment slot.

3. The seat of claim 2, wherein the backrest angle adjustment system comprises a pair of guides, one guide being located on either side of the angle adjustment slot, and wherein the backrest angle adjustment system further comprises a stop located at an upper end of the angle adjustment slot, wherein the stop is attached to the rear of the backrest and is adapted to abut the angle adjuster when the backrest is in a position of maximum recline.

4. The seat of claim 1, wherein the linkage system comprises a pair of arms, each arm comprising a substantially upright member and a substantially horizontal member, wherein the substantially upright members of the arms are located substantially centrally along the rear of the backrest and the horizontal members of the arms are located near the sides of the backrest and at the bottom of the backrest.

5. The seat of claim 1, wherein the backrest angle adjustment system further comprises a release pin configured to project from the angle adjuster and through an upright locking aperture located in the support structure of the backrest to lock the backrest in an upright position.

6. A seat comprising:

a base frame;

a seat base that is supported by the base frame;

a backrest;

a tilt adjustment system comprising a pair of side supports, each side support comprising at least one curved guide slot, wherein each side support is attached to the base frame by guide bearing that extends from the base frame and through the respective guide slot; and a linear actuator connected to the base frame and side supports, wherein the linear actuator is configured to increase and decrease its length upon activation, to cause the guide bearings to slide along the guide slots to adjust the tilt of the seat, and to lock the seat in position when the linear actuator is deactivated;

wherein the tilt adjustment system further comprises a release safety lock comprising a retractable locking pin configured to lock the base frame to a side support to lock the seat in an upright position.

7. A lateral support bracket for a seat, the bracket comprising:

a first portion extending in a first direction and configured to attach to a lateral support;

a second portion extending at an angle from the first portion; and a third portion extending from the second portion in a second direction that is substantially opposite the first direction, wherein the third portion is configured to attach to a backrest of a seat.

8. The lateral support bracket of claim 7, wherein the third portion comprises a second pivot joint configured to attach the lateral support bracket to the backrest, wherein the second pivot joint is also configured to enable the lateral support bracket to rotate about a longitudinal axis of the third portion.

9. A backrest comprising a lateral support bracket according to claim 8.

10. The backrest of claim 9, further comprising a back support comprising a substantially vertical slot, wherein the second pivot joint is configured to engage with and slide along the substantially vertical slot.

11. The lateral support bracket of claim 8, wherein the third portion is able to slide forward and backward within the second pivot joint.

12. A backrest comprising a lateral support bracket according to claim 11.

13. The lateral support bracket of claim 7, wherein the second portion of the bracket substantially extends at a right angle from the first portion of the bracket.

14. A backrest comprising a lateral support bracket according to claim 7.

15. A seat comprising a backrest according to claim 14.

16. A seat comprising:

a base frame;

a seat base supported by the base frame;

a footrest;

a footrest adjustment system comprising an actuator configured to adjust the angle of the footrest relative to the seat base, wherein the actuator is secured to at least one of the seat base and the base frame;

a release pin pivotably connecting the footrest and the actuator and configured to engage and disengage the footrest with the actuator; and a tilt adjustment controller for controlling the actuator and disposed so as to be actuated from a rear of the seat, wherein the actuator is configured to be activated from the rear of the seat.

17. The seat of claim 16, wherein when the footrest is disengaged from the actuator, the footrest is configured to be pivoted relative to the seat base to form a storage position in which the footrest is inverted and is located above the seat base.

18. The lateral support bracket of claim 7, wherein the first portion comprises a first pivot joint to which the lateral support can be hingedly attached so as to rotate about a longitudinal axis of the first portion.

* * * * *